US011801530B2

(12) United States Patent
Bi et al.

(10) Patent No.: US 11,801,530 B2
(45) Date of Patent: Oct. 31, 2023

(54) TEA LEAF AND TEA STEM SEPARATING DEVICE

(71) Applicant: Anhui Agricultural University, Hefei (CN)

(72) Inventors: Haijun Bi, Hefei (CN); Pengcheng Jia, Hefei (CN); Liangfei Fang, Hefei (CN); Chengmao Cao, Hefei (CN); Dongsong Xia, Hefei (CN); Zhengmin Wu, Hefei (CN); Changying Sun, Hefei (CN)

(73) Assignee: Anhui Agricultural University, Hefei (CN)

( * ) Notice: Subject to any disclaimer, the term of this patent is extended or adjusted under 35 U.S.C. 154(b) by 0 days.

(21) Appl. No.: 18/089,795

(22) Filed: Dec. 28, 2022

(65) Prior Publication Data

US 2023/0211377 A1 Jul. 6, 2023

(30) Foreign Application Priority Data

Dec. 31, 2021 (CN) ..... 202111677245.4

(51) Int. Cl.
*B07B 1/16* (2006.01)
*B07B 1/42* (2006.01)
*B07B 11/06* (2006.01)

(52) U.S. Cl.
CPC ..... *B07B 1/16* (2013.01); *B07B 1/42* (2013.01); *B07B 11/06* (2013.01)

(58) Field of Classification Search
CPC .. B07B 1/16; B07B 11/06; B07B 7/01; B07B 11/02; B07B 9/00; B07B 1/00; B07B 1/18; B07B 1/22; B07B 1/28; B07B 1/42; B07B 1/46; B07B 1/524; B07B 15/00; B07B 13/00; B07B 13/16; A23F 3/06; A23F 3/12; A23F 3/16
USPC ..... 209/3, 234, 235, 240, 284
See application file for complete search history.

(56) References Cited

U.S. PATENT DOCUMENTS 3,596,842 A * 8/1971 Barber ..... B65B 69/0008 414/412
2015/0027096 A1* 1/2015 Black ..... A01D 45/00 56/10.1

FOREIGN PATENT DOCUMENTS

CN 106179971 A * 12/2016
CN 208321005 U * 1/2019
CN 209613477 U * 11/2019

* cited by examiner

*Primary Examiner* — Gene O Crawford
*Assistant Examiner* — Muhammad Awais
(74) *Attorney, Agent, or Firm* — Nicholas Pfeifer; Smith & Hopen, P. A.

(57) ABSTRACT

Disclosed is a tea leaf and tea stem separating device. The tea leaf and tea stem separating device comprises a machine shell, wherein a collecting mechanism, a peeling mechanism, a separating mechanism, a rocker mechanism and recycling mechanisms are sequentially arranged on the machine shell in the falling direction of materials, a driving mechanism is arranged at the position, corresponding to the separating mechanism, of the inner wall of the machine shell, the driving mechanism is provided with a conveyor belt mechanism connected with the peeling mechanism, the separating mechanism and the rocker mechanism, and the driving mechanism can drive the conveyor belt mechanism to move so as to pull the peeling mechanism, the separating mechanism and the rocker mechanism to synchronously reciprocate.

10 Claims, 12 Drawing Sheets

TEA LEAF AND TEA STEM SEPARATING DEVICE

CROSS-REFERENCE TO RELATED APPLICATION

This patent application claims the benefit and priority of Chinese Patent Application No. 202111677245.4, filed with the China National Intellectual Property Administration on Dec. 31, 2021, the disclosure of which is incorporated by reference herein in its entirety as part of the present application.

TECHNICAL FIELD

The present disclosure relates to the technical field of tea screening, and specifically relates to a tea leaf and tea stem separating device.

BACKGROUND

Tea culture originates from China which is known as the hometown of tea. The history of tea culture in China can be traced back to 2700 BC, and tea was used as herbal medicine at that time. However, tea was officially used as a drink in about 59 BC. Tea making and drinking exist in thousands of years until the 21st century, and there are many famous products, such as green tea, white tea, yellow tea, black tea, red tea, scented tea and oolong tea. In recent years, great progress has been made in the development of tea machinery. The products such as tea pruning machines, tea pickers, liquefied gas de-enzyming machines and team greening special equipment are continuously upgraded, so that the quality and production level of tea are raised. Through the vigorous development of modern tea machinery, the labor intensity of tea making in tea picking industry is reduced, the work efficiency is improved, and the production level and quality of tea are improved. In the process of tea processing, in order to improve the quality of tea, the step of sorting out tea stems in tea is an important process in the tea refining process. The traditional stem sorting method is low in efficiency, and the quality requirements of the same batch and the grade are difficult to meet.

Although there is a multi-stage screening method in the prior art to realize the separation of tea leaves and tea stems, the operation is prone to cause the situation that the materials screened by the first stage of screening have been dropped when the second stage of screening is not officially started due to the blank of screening, resulting in incomplete screening of some materials.

SUMMARY

The present disclosure aims to provide a tea leaf and tea stem separating device so as to solve the technical problem in the prior art that it is difficult to avoid materials from falling from the interval in the multistage screening process.

In order to solve the technical problem, the present disclosure provides the following technical schemes.

A tea leaf and tea stem separating device comprises a machine shell, wherein a collecting mechanism, a peeling mechanism, a separating mechanism, a rocker mechanism and recycling mechanisms are sequentially arranged on the machine shell in the falling direction of materials, a driving mechanism is arranged at the position, corresponding to the separating mechanism, of the inner wall of the machine shell, the driving mechanism is provided with a conveyor belt mechanism connected with the peeling mechanism, the separating mechanism and the rocker mechanism, and the driving mechanism can drive the conveyor belt mechanism to move so as to pull the peeling mechanism, the separating mechanism and the rocker mechanism to synchronously reciprocate;

the peeling mechanism comprises at least three soft-bristled brushes which are arranged in parallel and both ends of which are connected with the inner wall of the machine shell, the transmission end of each soft-bristled brush is connected with the conveyor belt mechanism, and the conveyor belt mechanism can drive the at least three soft-bristled brushes to rotate to screen the materials;

the separating mechanism comprises separating rollers arranged in parallel on the side, close to the rocker mechanism, of the soft-bristled brush, a connecting rod connected with the inner wall of the machine shell penetrates through the axis of the separating roller, the transmission end of the separating roller is connected with the conveyor belt mechanism, the output end of the driving mechanism is connected with the connecting rod penetrating through the axis of the separating roller and can drive the connecting rod to rotate so as to guide the conveyor belt mechanism to work, and the conveyor belt mechanism can rotate the separating roller while driving the at least three soft-bristled brushes to rotate so as to further screen the materials;

the rocker mechanism comprises a first rocker and two second rockers which are arranged in parallel with the separating roller, and a strip-shaped sieve plate which is horizontally arranged at the bottom of the machine shell, the two second rockers are respectively arranged on one side surface of the strip-shaped sieve plate in parallel and connected with the inner wall of the machine shell, the first rocker is arranged on the other side surface of the strip-shaped sieve plate, the end of the first rocker is connected with the inner wall of the machine shell, the side wall of the first rocker is connected with the conveyor belt mechanism, and the conveyor belt mechanism can drive the first rocker to reciprocate while driving the peeling mechanism and the separating mechanism to move.

As a preferred scheme of the present disclosure, the recycling mechanisms comprise two collection boxes, the two collection boxes are respectively connected to the two sides of the machine shell, and the collection boxes are used for storing the materials screened out by the strip-shaped sieve plate.

As a preferred scheme of the present disclosure, the collecting mechanism comprises a material inlet and an internal collecting port, the material inlet is connected to the top outer wall of the machine shell and located just above the peeling mechanism, the internal collecting port is connected to the top inner wall of the machine shell and located just below the material inlet, the two ends of the internal collecting port are provided with material baffles, and the material baffles are located on the two sides of the peeling mechanism.

As a preferred scheme of the present disclosure, the conveyor belt mechanism comprises a plurality of driven pulleys for driving the peeling mechanism to move, a driving pulley for driving the separating mechanism, a second pulley and a third pulley;

the driven pulleys are respectively connected to the transmission ends of the at least three soft-bristled brushes in one-to-one correspondence, and the driven pulleys can be driven by the driving pulley so as to guide the soft-bristled brushes to rotate and screen the materials;

both the second pulley and the driving pulley sleeve the side wall of the connecting rod, both the second pulley and the driving pulley are arranged at the transmission end of the separating roller, and the driving pulley can drive the driven pulleys to rotate so that the separating roller and the soft-bristled brushes simultaneously rotate to further screen the materials; and the first rocker is connected with the third pulley, the second pulley is connected with the third pulley through a belt, and the output end of the driving mechanism is connected with the connecting rod penetrating through the axis of the separating roller and can drive the connecting rod to rotate so as to guide the second pulley, the driving pulley and the first rocker to simultaneously rotate.

As a preferred scheme of the present disclosure, an outer cover cylinder connected with the inner wall of the machine shell sleeves the outer side of the separating roller, a falling port is formed in the surface of the outer cover cylinder, an inclined converging groove is formed in the interior of the outer cover cylinder, a plurality of filtering holes are formed in the inner wall of the inclined converging groove, and a storage groove is formed in the bottom inner wall of the inclined converging groove; and the outer side wall of the separating roller is provided with a screw propelling channel, a roller pressing column is connected into the screw propelling channel, a spacing channel is arranged on the screw propelling channel, and the position, corresponding to the falling port, of the inner wall of the outer cover cylinder is provided with a gradual change column bag group.

As a preferred scheme of the present disclosure, a rotating half cylinder matched with the longitudinal section shape of the storage groove is rotatably connected into the storage groove, an interlayer is arranged between the inner wall and the outer wall of the outer cover cylinder, a packing block is connected into the interlayer, adjusting holes are formed in the positions, corresponding to the filtering holes, of the surface of the packing block, both ends of the packing block are connected with the rotating half cylinder, and the rotating half cylinder can push the packing block to reciprocate in the interlayer.

As a preferred scheme of the present disclosure, a winnowing sleeve is arranged at the end, away from the driving mechanism, of the outer cover cylinder, an inclined guide surface is arranged between the winnowing sleeve and the edge of the inclined converging groove, an winnowing plate is installed at the bottom of the winnowing sleeve, and the inclined guide surface can guide tea stems to enter the inclined converging groove.

As a preferred scheme of the present disclosure, the length of the inclined converging groove is not less than that of the separating roller, and the length of the gradual change column bag group is not greater than that of the separating roller.

As a preferred scheme of the present disclosure, the two end surfaces of the strip-shaped sieve plate are provided with elastic baffles, and the elastic baffles are used for preventing the materials from directly falling into the strip-shaped sieve plate.

As a preferred scheme of the present disclosure, the strip-shaped sieve plate is slidably connected with a pushing baffle, the strip-shaped sieve plate is provided with a limiting strip for blocking the pushing baffle, and the pushing baffle is connected with a grid rack; and the pushing baffle can slide along the side wall of the strip-shaped sieve plate with the grid rack, and pushes the materials to press down the elastic baffle in the sliding process and sends the materials into the collection box.

Compared with the prior art, the tea leaf and tea stem separating device has the following beneficial effects.

According to the tea leaf and tea stem separating device, the pulled peeling mechanism, separating mechanism and rocker mechanism can be driven by the conveyor belt mechanism to synchronously reciprocate so as to eliminate the interval during multi-stage screening. Meanwhile, three-stage screening is achieved during screening. Tea leaves and tea stems can be fully screened out, and the situation that the tea leaves and the tea stems are mixed again due to the fact that the tea stems become thin in the screening process of the tea leaves and the tea stems is avoided.

BRIEF DESCRIPTION OF THE DRAWINGS

In order to more clearly illustrate the description of the present disclosure or the technical solutions in the prior art, the drawings, which need to be used in the description or the prior art description, are briefly described below. Apparently, the attached figures in the following description are merely exemplary. For ordinary technical staff in the art, under the premise of without contributing creative labor, other implementation attached figures further can be obtained according to these attached figures.

Figure 1:
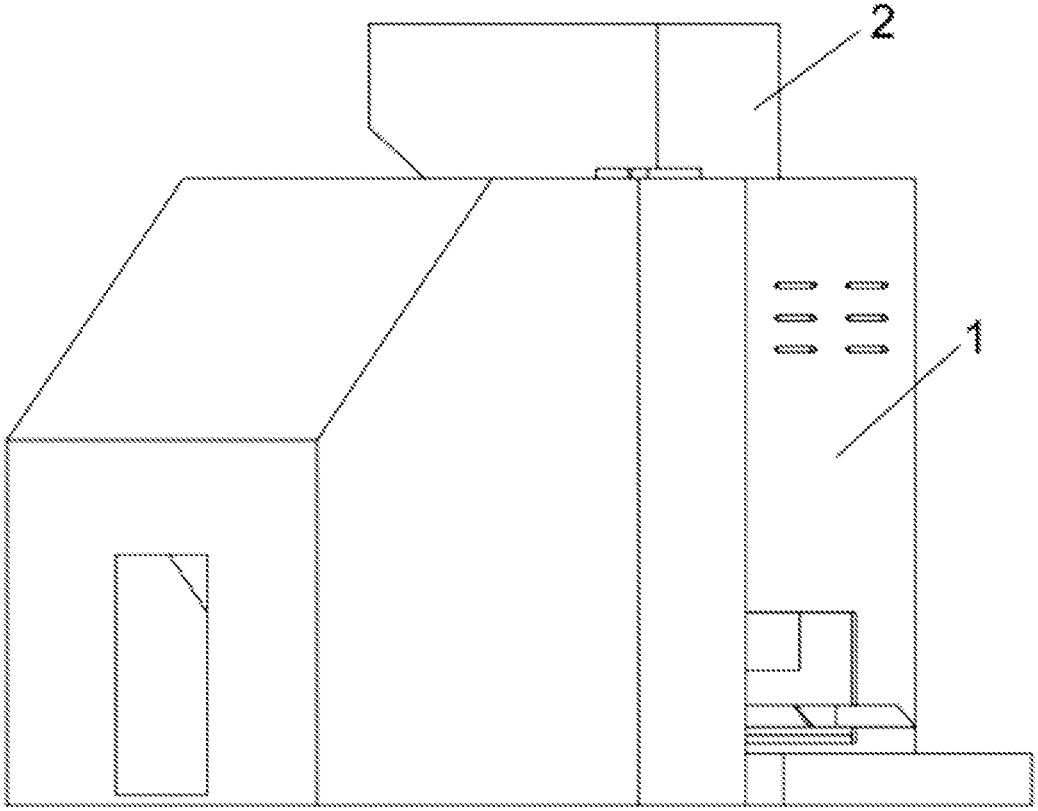
FIG. 1 is a structural schematic diagram of a machine shell in the embodiment of the present disclosure.
Figure 2:
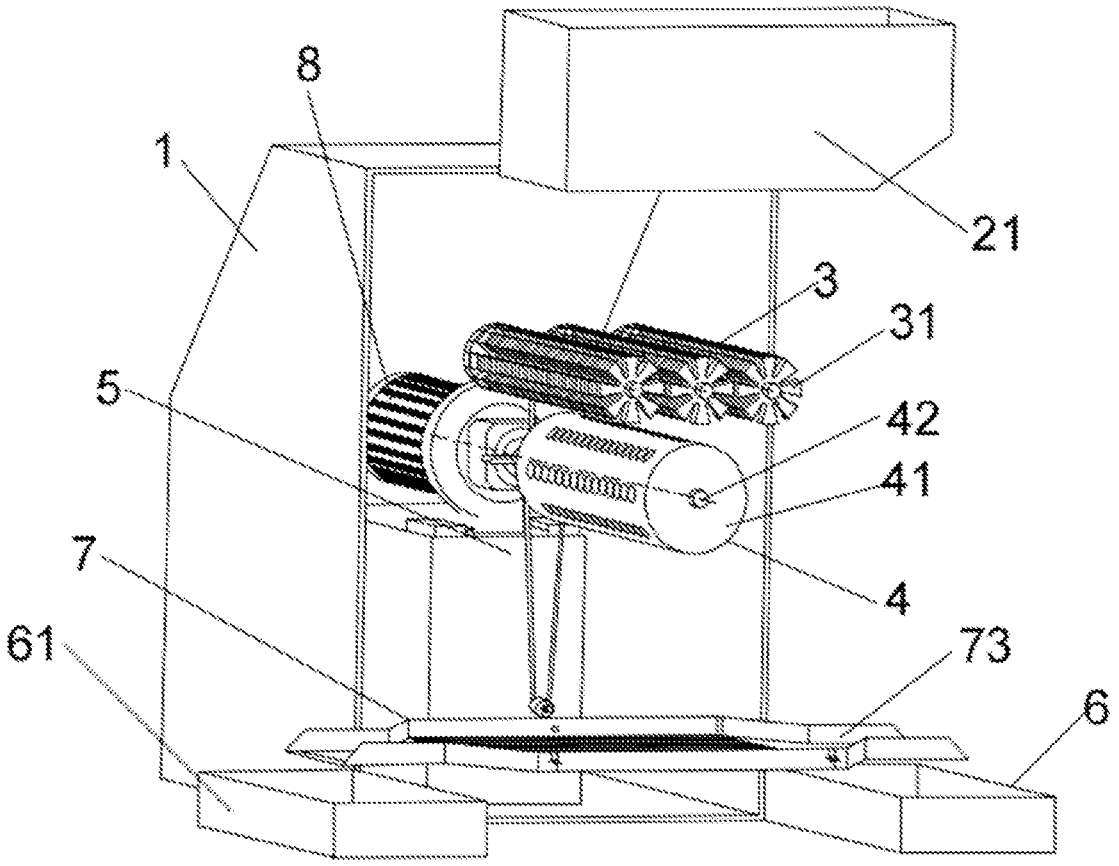
FIG. 2 is a structural schematic diagram of a peeling mechanism in the embodiment of the present disclosure.

Reference signs in the attached figures:

1, machine shell; 2, collecting mechanism; 3, peeling mechanism; 4, separating mechanism; 5, conveyor belt mechanism; 6, recycling mechanism; 7, rocker mechanism; 8, driving mechanism; 9, packing block;

21, material inlet; 22, internal collecting port; 23, material baffle;

31, soft-bristled brush; 41, separating roller; 42, connecting rod;

411, outer cover cylinder; 412, falling port; 413, inclined converging groove; 414, filtering hole; 415, storage groove; 416, screw propelling channel; 417, roller pressing column; 418, gradual change column bag group; 419, interlayer;

51, second pulley; 52, third pulley; 53, driven pulley; 54, driving pulley;

61, collection box; 71, first rocker; 72, second rocker; 73, strip-shaped sieve plate; 74, elastic baffle; 75, pushing baffle; 76, limiting strip; 77, grid rack;

91, adjusting hole; 92, rotating half cylinder; 93, winnowing sleeve; 94, winnowing plate; and 95, inclined guide surface.

DETAILED DESCRIPTION OF THE EMBODIMENTS

The following clearly and completely describes the technical scheme in the embodiments of the present disclosure with reference to the attached figures in the embodiments of the present disclosure. Apparently, the described embodiments are merely a part rather than all of the embodiments of the present disclosure. Based on the embodiment in the present disclosure, all other embodiments obtained by the ordinary technical staff in the art under the premise of without contributing creative labor belong to the scope protected by the present disclosure.

As shown in FIG. 1 to FIG. 17, the present disclosure provides a tea leaf and tea stem separating device, comprising a machine shell 1 (the machine shell 1 is a cuboid frame structure made of aluminum alloy). A collecting mechanism 2, a peeling mechanism 3, a separating mechanism 4, a rocker mechanism 7 and recycling mechanisms 6 are sequentially arranged on the machine shell 1 in the falling direction of materials. A driving mechanism 8 is arranged at the position, corresponding to the separating mechanism 4, of the inner wall of the machine shell 1. The driving mechanism 8 is provided with a conveyor belt mechanism 5 connected with the peeling mechanism 3, the separating mechanism 4 and the rocker mechanism 7. The driving mechanism 8 can drive the conveyor belt mechanism 5 to move so as to pull the peeling mechanism 3, the separating mechanism 4 and the rocker mechanism 7 to synchronously reciprocate.

The peeling mechanism 3 comprises at least three soft-bristled brushes 31 which are arranged in parallel and both ends of which are connected with the inner wall of the machine shell 1. The transmission end of each soft-bristled brush 31 is connected with the conveyor belt mechanism 5. The conveyor belt mechanism 5 can drive the at least three soft-bristled brushes 31 to rotate to screen the materials.

The separating mechanism 4 comprises separating rollers 41 arranged in parallel on the side, close to the rocker mechanism 7, of the soft-bristled brush 31. A connecting rod 42 connected with the inner wall of the machine shell 1 penetrates through the axis of the separating roller 41 (The length of the connecting rod 42 is not limited as long as the separating roller 41 can be driven to rotate.). The transmission end of the separating roller 41 is connected with the conveyor belt mechanism 5. The output end of the driving mechanism 8 is connected with the connecting rod 42 penetrating through the axis of the separating roller 41 and can drive the connecting rod 42 to rotate so as to guide the conveyor belt mechanism 5 to work. The conveyor belt mechanism 5 can rotate the separating roller 41 while driving the at least three soft-bristled brushes 31 to rotate so as to further screen the materials.

The rocker mechanism 7 comprises a first rocker 71 and two second rockers 72 which are arranged in parallel with the separating roller 41, and a strip-shaped sieve plate 73 which is horizontally arranged at the bottom of the machine shell 1. The two second rockers 72 are respectively arranged on one side surface of the strip-shaped sieve plate 73 in parallel and connected with the inner wall of the machine shell 1. The first rocker 71 is arranged on the other side surface of the strip-shaped sieve plate 73, and the end of the first rocker 71 is connected with the inner wall of the machine shell 1. The side wall of the first rocker 71 is connected with the conveyor belt mechanism 5. The conveyor belt mechanism 5 can drive the first rocker 71 to reciprocate while driving the peeling mechanism 3 and the separating mechanism 4 to move.

According to the tea leaf and tea stem separating device, the pulled peeling mechanism 3, separating mechanism 4 and rocker mechanism 7 can be driven by the conveyor belt mechanism 5 to synchronously reciprocate so as to eliminate the interval during multi-stage screening. Meanwhile, three-stage screening is achieved during screening. Tea leaves and tea stems can be fully screened out, and the situation that the tea leaves and the tea stems are mixed again due to the fact that the tea stems become thin in the screening process of the tea leaves and the tea stems is avoided. At the same time, multi-stage sorting is carried out by using the different characteristics of the tea stems (the independent screening of the tea stems is realized mainly through strip-shaped sieve holes in the separating roller 41), and the tea stems and tea foam in tea are effectively screened, so that the labor intensity of workers is reduced, the labor cost and material cost are saved, the work efficiency is improved, the production level and quality of tea are ensured, and the quality requirements of the same batch and the same grade are met.

When the tea leaf and tea stem separating device works specifically, the driving mechanism 8 is directly started (the driving mechanism 8 specifically can be a motor. The output end of the motor can be connected with the driving pulley 54 or the connecting rod 42, and is preferably connected with the connecting rod 42. The motor is a three-phase asynchronous alternating-current motor, and can rotate back and forth within a certain number of turns. The specification is YS8028, the rated power is 250 W, and the terminal output speed is 680 rpm.).

Figure 3:
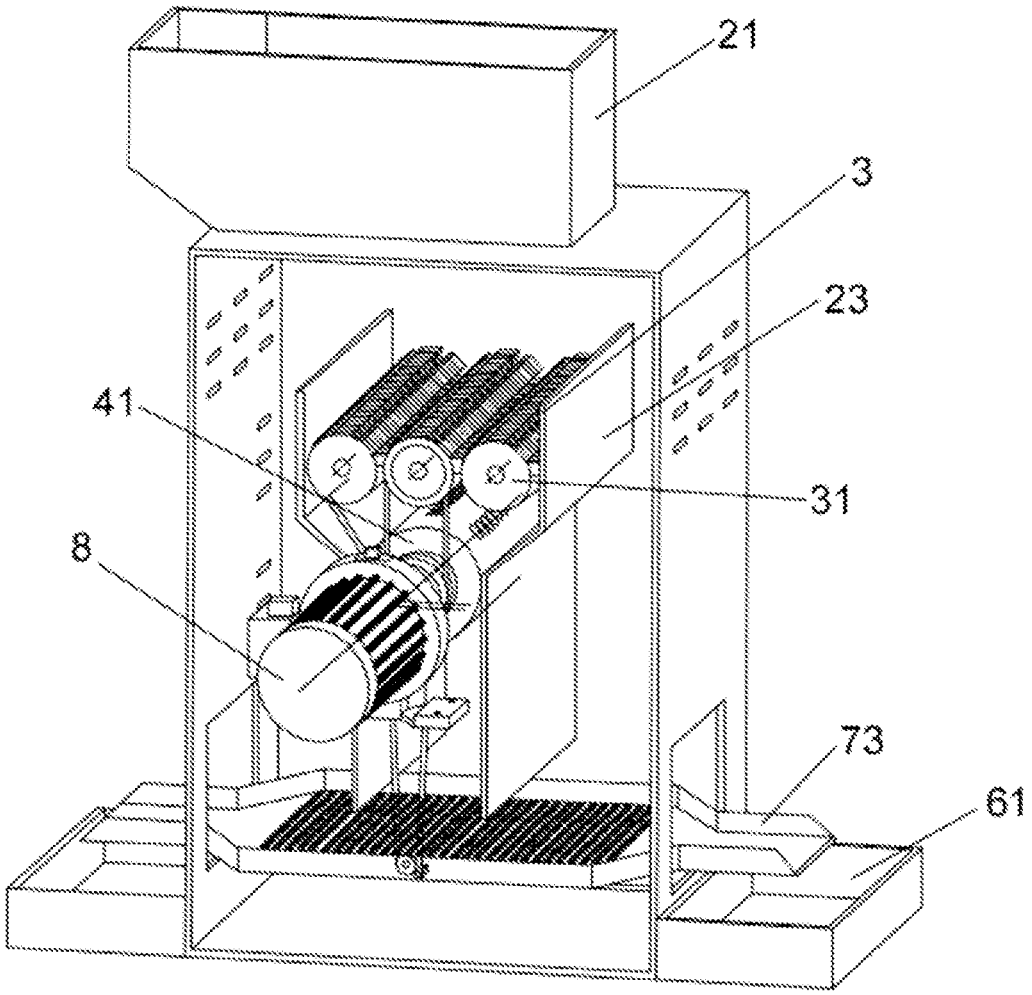
FIG. 3 is a structural schematic diagram of a separating mechanism in the embodiment of the present disclosure.
Figure 4:
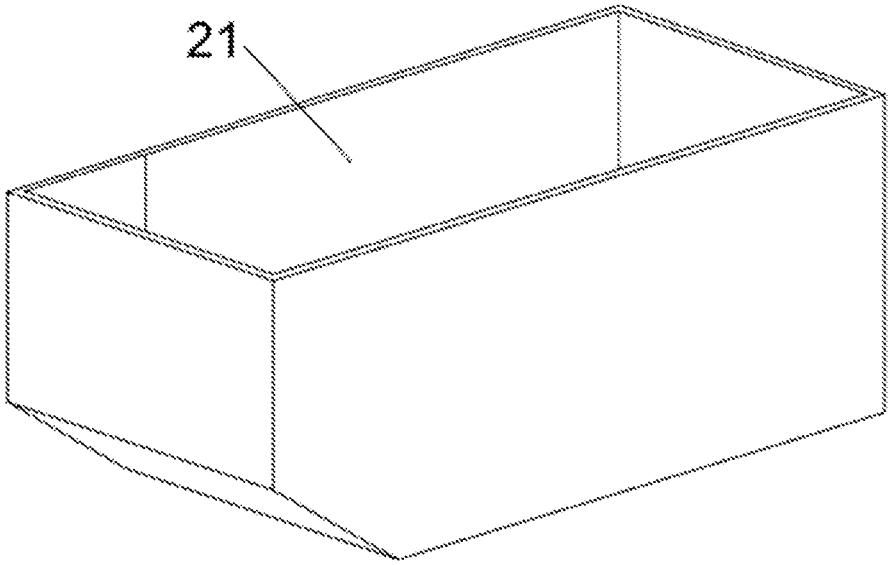
FIG. 4 is a schematic structural diagram of a material inlet in the embodiment of the present disclosure.
Figure 5:
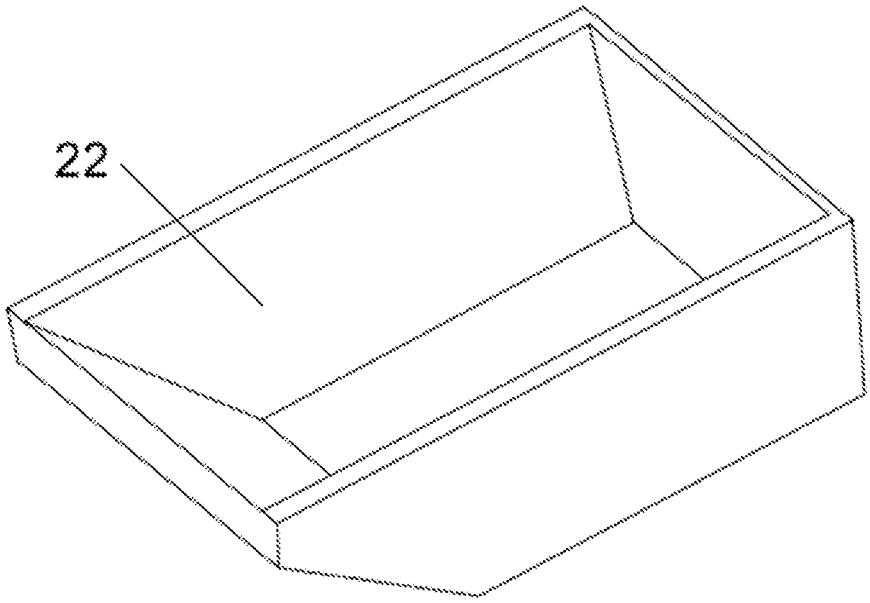
FIG. 5 is a structural schematic diagram of an internal collecting port in the embodiment of the present disclosure.
Figure 6:
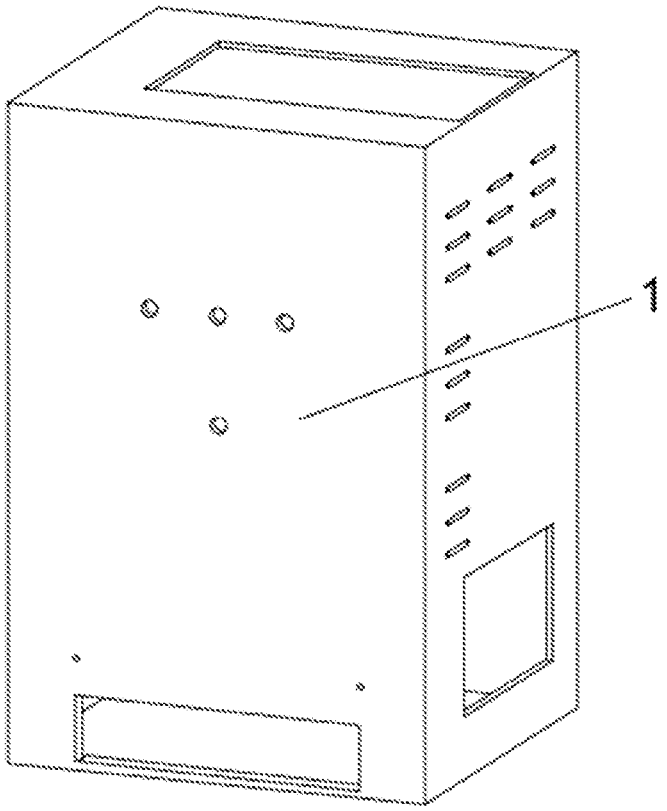
FIG. 6 is a stereoscopic diagram of a machine shell in the embodiment in the present disclosure.
Figure 7:
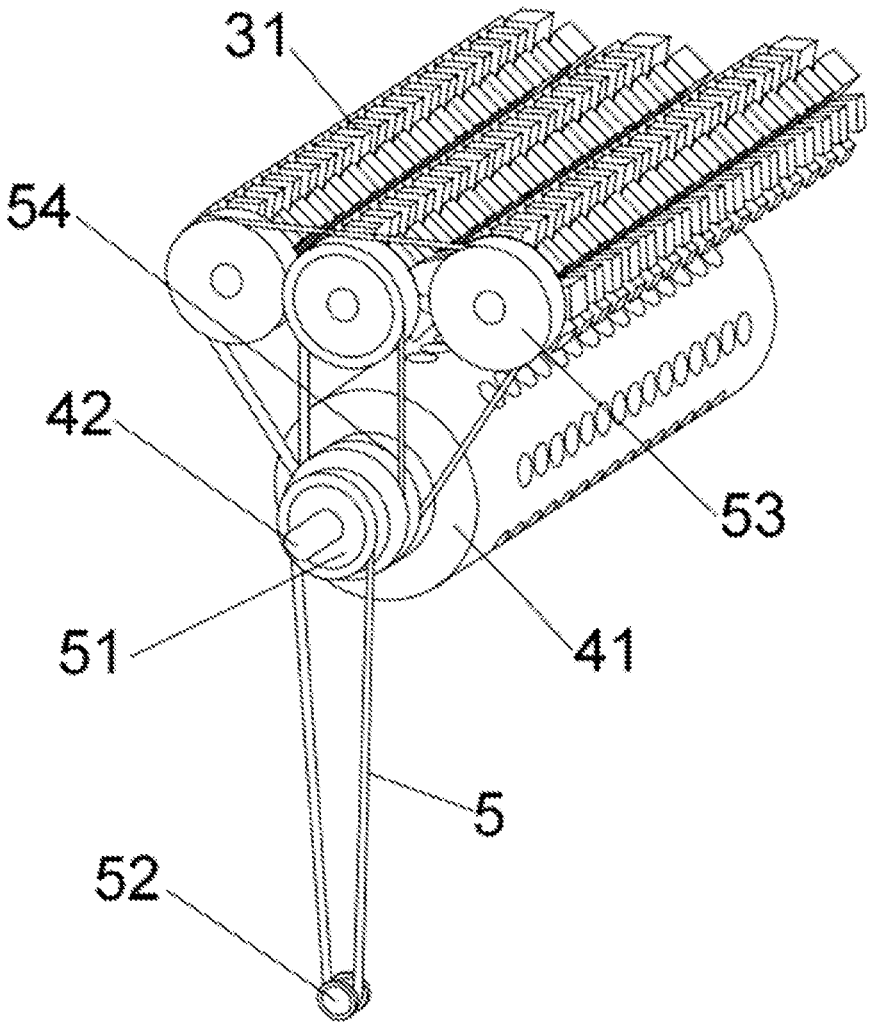
FIG. 7 is a structural schematic diagram of a conveyor belt mechanism in the embodiment of the present disclosure.
Figure 8:
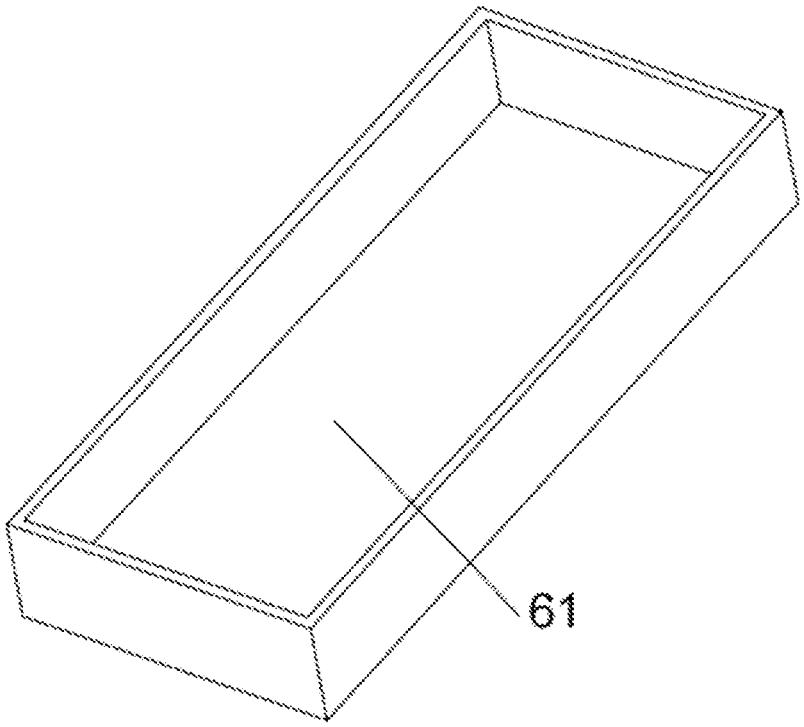
FIG. 8 is a structural schematic diagram of a collection box in the embodiment of the present disclosure.
Figure 9:
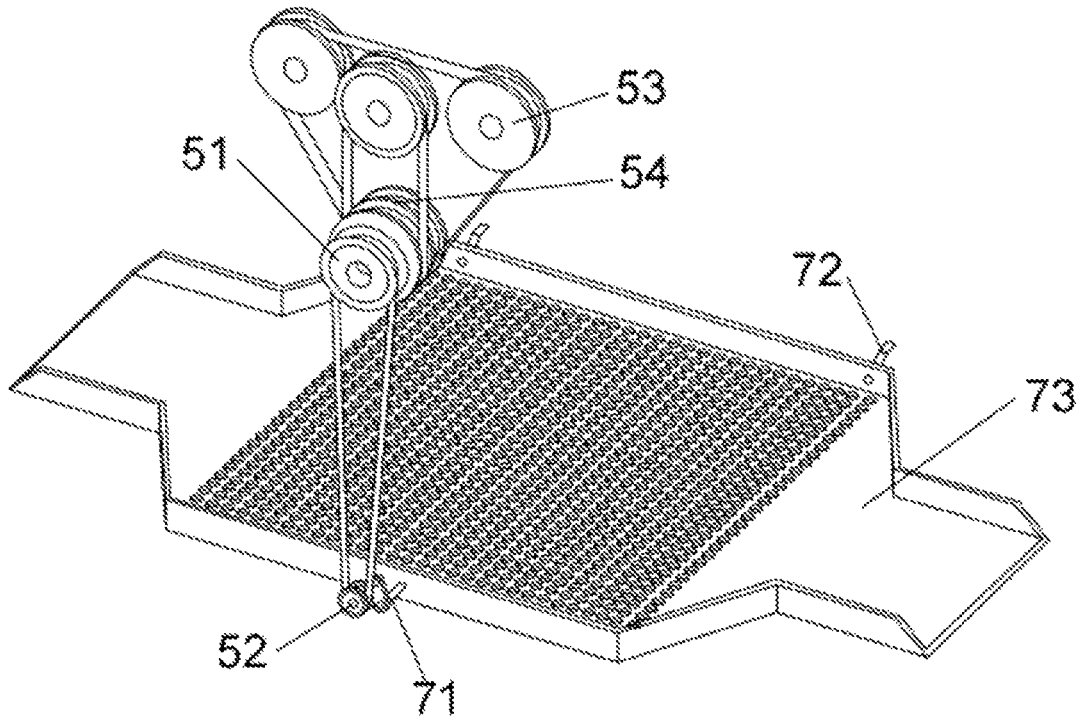
FIG. 9 is a structural schematic diagram of a strip-shaped sieve plate in the embodiment of the present disclosure.
Figure 10:
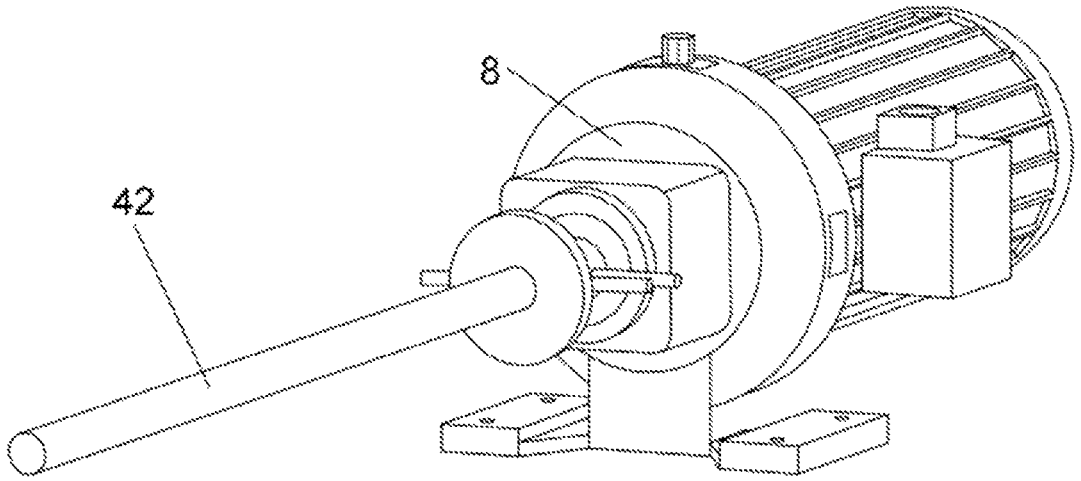
FIG. 10 is a structural schematic diagram of a driving mechanism in the embodiment of the present disclosure.
Figure 11:
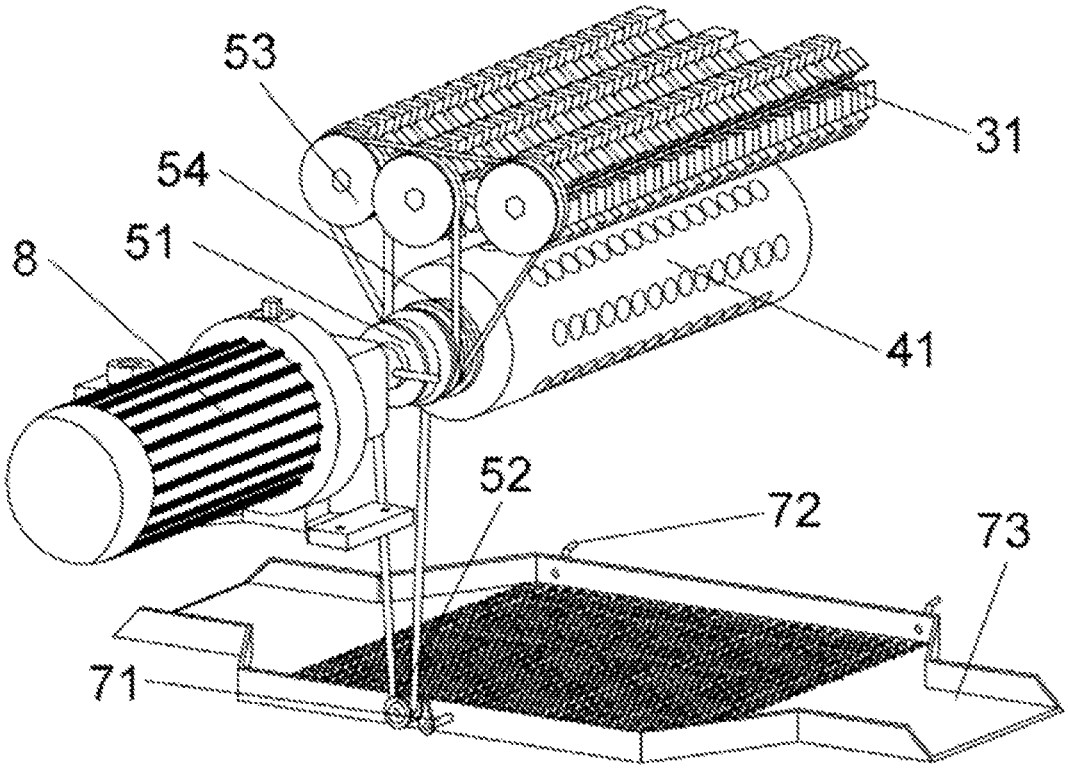
FIG. 11 is a stereoscopic diagram of a peeling mechanism and a separating mechanism in the embodiment of the present disclosure.
Figure 12:
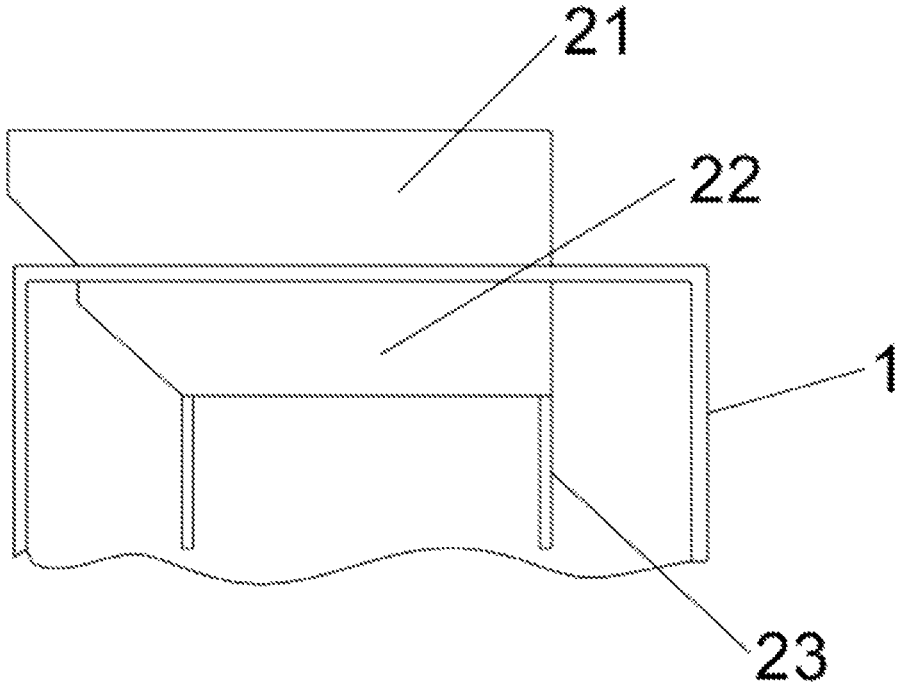
FIG. 12 is a structural schematic diagram of a material baffle during installation in the embodiment of the present disclosure.

And then, the movable driving mechanism 8 can directly guide the conveyor belt mechanism 5 and the connecting rod 42 to move at the same time. The separating rollers 41, the soft-bristled brushes 31 and the first rocker 71 can be simultaneously driven to reciprocate when the conveyor belt mechanism 5 and the connecting rod 42 move. At that time, the input materials can be concentrated to be thrown to the soft-bristled brushes 31 through the collecting mechanism 2, and then the soft-bristled brushes 31 can peel off the materials so that the tea leaves and the tea stems in the materials are scattered and peeled off. Then, the peeled materials can fall to the separating mechanism 4. At that time, the separating mechanism 4 can screen the materials so that the strip-shaped tea stems are recycled by the separating device 4, and the granular tea leaves fall into the strip-shaped sieve plate 73. At that time, the strip-shaped sieve plate 73 can be driven by the conveyor belt mechanism 5 to reciprocate and swing left and right, as shown in FIG. 3. The working principle of the strip-shaped sieve plate 73 is similar to that of a vibrating screen, so that strip-shaped and small-volume materials are piled up on the surface of the strip-shaped sieve plate 73 by vibration, and large-volume materials are piled up on the surface of the small-volume materials.

Then, when the strip-shaped sieve plate 73 swings left and right, large-volume tea leaves fall into the recycling mechanisms 6 at both ends, and the small-volume materials fall into the bottom of the machine shell 1 through the screening of the strip-shaped sieve plate 73.

Further, the recycling mechanisms 6 comprise two collection boxes 61, the two collection boxes 61 are respectively connected to the two sides of the machine shell 1, and the collection boxes 61 are used for storing the materials screened out by the strip-shaped sieve plate 73.

Further, the collecting mechanism 2 comprises a material inlet 21 and an internal collecting port 22. The material inlet 21 is connected to the top outer wall of the machine shell 1 and located just above the peeling mechanism 3. The internal collecting port 22 is connected to the top inner wall of the machine shell 1 and located just below the material inlet 21. The two ends of the internal collecting port 22 are provided with material baffles 23. The material baffles 23 are located on the two sides of the peeling mechanism 3. Through the cooperation of the material inlet 21 and the internal collecting port 22, the input materials can be concentrated to be put in the direction of the peeling mechanism 3. Through the arrangement of and the material baffle 22, the tea leaves scattered by the peeling mechanism 3 during the peeling process can be blocked so as to prevent the tea leaves from splashing to everywhere.

Further, the conveyor belt mechanism 5 comprises a plurality of driven pulleys 53 for driving the peeling mechanism 3 to move, a driving pulley 54 for driving the separating mechanism 4, a second pulley 51 and a third pulley 52.

The driven pulleys 53 are respectively connected to the transmission ends of the at least three soft-bristled brushes 31 in one-to-one correspondence, and the driven pulleys 53 can be driven by the driving pulley 54 so as to guide the soft-bristled brushes 31 to rotate and screen the materials.

Both the second pulley 51 and the driving pulley 54 sleeve the side wall of the connecting rod 42. Both the second pulley 51 and the driving pulley 54 are arranged at the transmission end of the separating roller 41. The driving pulley 54 can drive the driven pulleys 53 to rotate so that the separating roller 41 and the soft-bristled brushes 31 simultaneously rotate to further screen the materials.

The first rocker 71 is connected with the third pulley 52. The second pulley 51 is connected with the third pulley 52 through a belt. The output end of the driving mechanism 8 is connected with the connecting rod 42 penetrating through the axis of the separating roller 41 and can drive the connecting rod 42 to rotate so as to guide the second pulley 51, the driving pulley 54 and the first rocker 71 to simultaneously rotate.

In the embodiment, the driving pulley 54 and the driven pulley 53 are equal in diameters.

The wheels in the conveyor belt mechanism 5 are specifically connected through belts in the prior art, or through chains, and are specifically set according to requirements.

The conveyor belt mechanism 5 is mainly used for driving the peeling mechanism 3, the separating mechanism 4 and the rocker mechanism 7 to reciprocate synchronously. During working, the second pulley 51 and the driving pulley 54 can be directly driven by the connecting rod 42 driven by the motor, and then the driving pulley 54 can drive the driven pulley 53 so as to guide the soft-bristled brush 31 to rotate and screen the materials. At the same time, the separating roller 41 and the first rocker 71 rotate at the same time to further screen the materials after primary screening.

Further, in order to prevent the separating roller 41 from being unable to screen the tea stems due to the rapid falling of the materials, preferably, an outer cover cylinder 411 connected with the inner wall of the machine shell 1 sleeves the outer side of the separating roller 41. A falling port 412 is formed in the surface of the outer cover cylinder 411. An inclined converging groove 413 is formed in the interior of the outer cover cylinder 411. A plurality of filtering holes 414 are formed in the inner wall of the inclined converging groove 413. A storage groove 415 is formed in the bottom inner wall of the inclined converging groove 413.

The outer side wall of the separating roller 41 is provided with a screw propelling channel 416. A roller pressing column 417 is connected into the screw propelling channel 416. A spacing channel is arranged on the screw propelling channel 416. The position, corresponding to the falling port 412, of the inner wall of the outer cover cylinder 411 is provided with a gradual change column bag group 418.

In the embodiment, the inclination angle of the inclined converging groove 413 should not be too large as long as the materials can slide in the inclined converging groove 413. The peeling mechanism 3 can also be partially inclined (only the pulley groove on the pulley needs to be inclined when the third pulley 52 is arranged, and most pulleys in the prior art are provided with pulley grooves, so the purpose of enabling the third pulley 52 to drive the first rocker 71 to rotate only by adjusting the pulley groove on the third pulley 52), so that the scattered materials are mostly converged to the lowest end of the inclined converging groove 413 (that is the end away from a winnowing sleeve 93).

The roller pressing column 417 and the inner wall of the screw propelling channel 416 can be connected together through a rotating shaft.

When the materials are scattered, the materials can directly fall into the inclined converging groove 413 through the falling port 412. And then, the separating roller 41 rotates all the time, so the separating roller 41 pushes the materials to slide towards the winnowing sleeve 93 along the inner wall of the inclined converging groove 413 through the screw propelling channel 416 on the side wall.

When the materials slide towards the winnowing sleeve 93 along the inner wall of the inclined converging groove 413, the roller pressing column 417 can press the materials so that some fine materials can be directly discharged through the filtering holes 414, but only the tea leaves and the stems can be pushed in the screw propelling channel 416. In the process of pushing the tea leaves and the tea stems, the gradual change column bag group 418 (which can be made of rubber material) can make contact with the tea leaves and the tea stems pushed by the roller pressing column 417, so that the tea leaves and the tea stems can enter the separating roller 41 more easily. The roller pressing column 417 can be pushed by the gradual change column bag group 418 when making contact with the gradual change column bag group 418, and rotates in the screw propelling channel 416, so that the tea leaves and the tea stems discharged from the roller pressing column 417 cannot be piled up and blocked.

In the embodiment, through the arrangement of the spacing channel, a part of tea leaves and tea stems can be guided to stay in the inclined converging groove 413 for a longer time. At that time, the less the amount of tea leaves and tea stems, the longer the retention time is. Because the last remaining materials must be more tea stems (here which are obtained in combination with the winnowing sleeve 93), the purpose of fully screening the materials can be achieved.

Further, in order to prevent more tea stems remaining in the inclined converging groove 413 from being piled up so that the tea stems fall down with the tea leaves to result in poor screening effect, preferably, a rotating half cylinder 92 matched with the longitudinal section shape of the storage groove 415 is rotatably connected into the storage groove 415. An interlayer 419 is arranged between the inner wall and the outer wall of the outer cover cylinder 411. A packing block 9 is connected into the interlayer 419. Adjusting holes 91 are formed in the positions, corresponding to the filtering holes 414, of the surface of the packing block 9. Both ends of the packing block 9 are connected with the rotating half cylinder 92. The rotating half cylinder 92 can push the packing block 9 to reciprocate in the interlayer 419.

Figure 14:
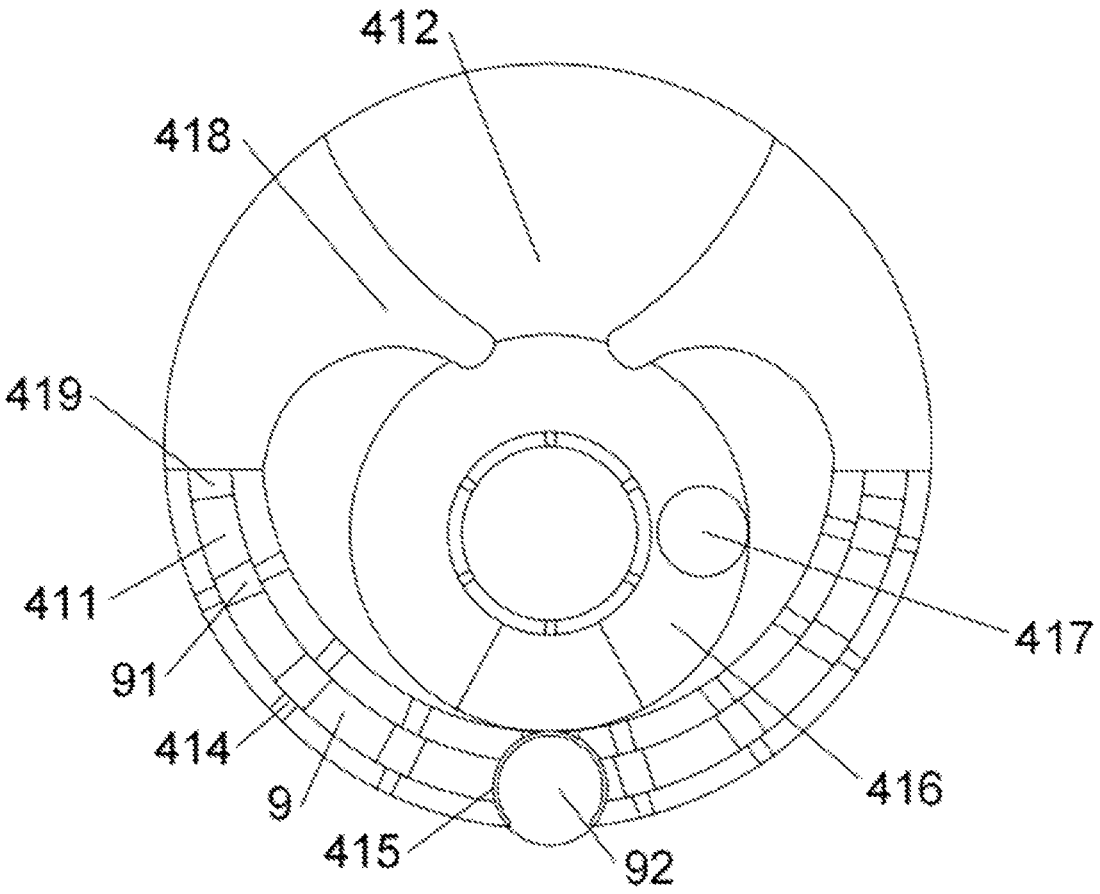
FIG. 14 is a structural schematic diagram of a left longitudinal section of an outer cover cylinder in the embodiment of the present disclosure.
Figure 15:
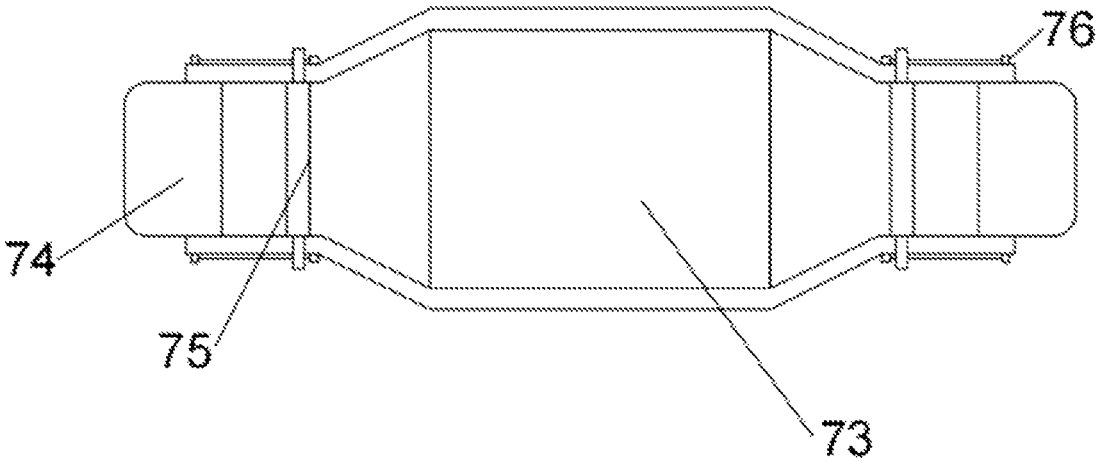
FIG. 15 is a top view of an elastic baffle in the embodiment of the present disclosure.
Figure 16:
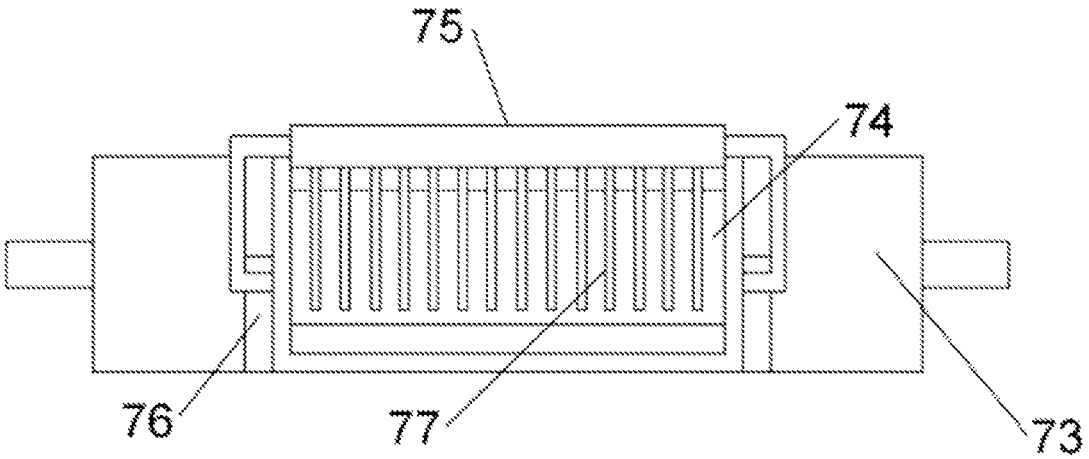
FIG. 16 is a side view of a grid rack in the embodiment of the present disclosure.
Figure 17:
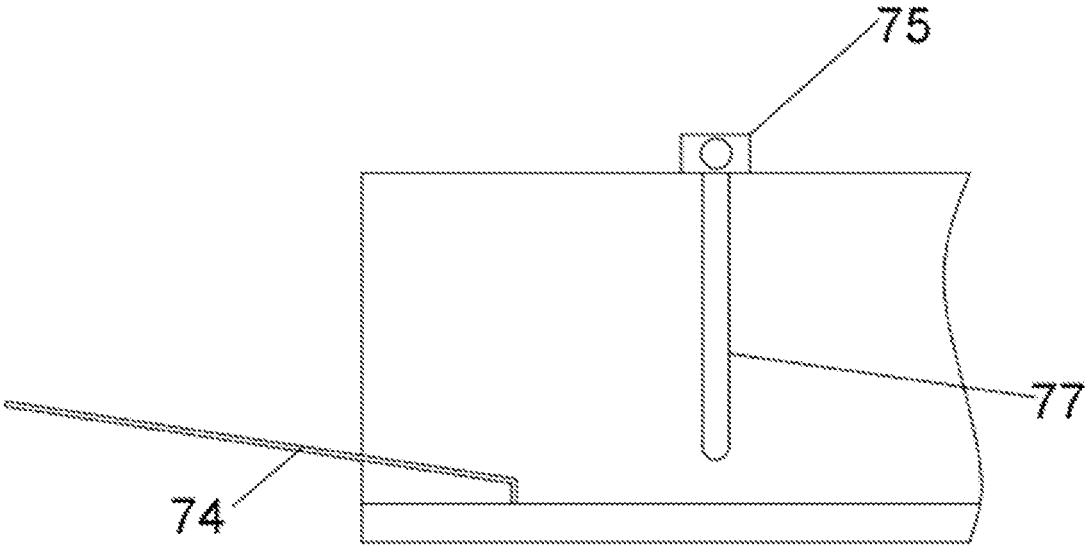
FIG. 17 is a structural schematic diagram of a side longitudinal section of a grid rack in the embodiment of the present disclosure.

When more tea stems remain in the inclined converging groove 413, the rotating half cylinder 92 can be rotated. The specific structure of the rotating half cylinder 92 is shown in FIG. 14. A concave cavity is formed in the rotating half cylinder 92. When the concave cavity in the rotating half cylinder 92 is aligned with the separating roller 41, the tea stems remaining in the inclined converging groove 413 can fall into the concave cavity, and then the tea stems can be discharged by rotating the rotating half cylinder 92 again.

In the process of rotating the rotating half cylinder 92, once the cavity faces the interlayer 419, the packing block 9 slidably connected into the interlayer 419 can slide into the cavity, so that the tea stems blocked at the filtering hole 414 are broken. Once the rotating half cylinder 92 is rotated again, the packing block 9 can be pushed out of the cavity by the rotating half cylinder 92.

Further, in order to improve the screening efficiency of the tea leaves and the tea stems, preferably, a winnowing sleeve 93 is arranged at the end, away from the driving mechanism 8, of the outer cover cylinder 411. An inclined guide surface 95 is arranged between the winnowing sleeve 93 and the edge of the inclined converging groove 413. A winnowing plate 94 is installed at the bottom of the winnowing sleeve 93. The inclined guide surface 95 can guide tea stems to enter the inclined converging groove 413.

Figure 13:
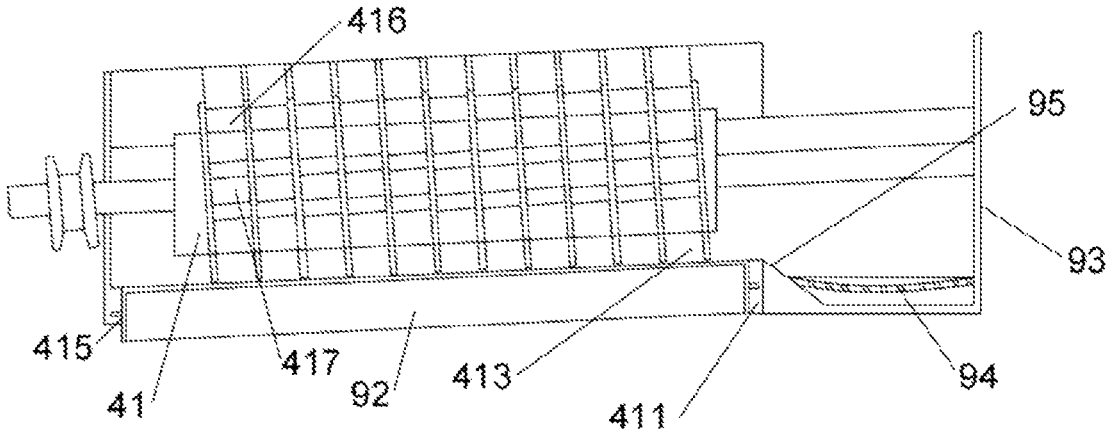
FIG. 13 is a structural schematic diagram of a main longitudinal section of an outer cover cylinder in the embodiment of the present disclosure.

When the tea leaves and the tea stems are pushed into the winnowing sleeve 93, the winnowing plate 94 (which can be blown under the winnowing plate 94 by external blowing equipment, as shown in FIG. 13) can blow up the tea leaves and the tea stems. Because the tea leaves are light in weight, the tea leaves rise higher than the falling port 412 as shown in FIG. 13 and FIG. 14, so that the tea leaves fall over the falling port 412 to the strip-shaped sieve plate 73 (That is to say, the blown air force is greater than the weight of the tea leaves and less than the weight of the tea stems. The application mode of the principle is disclosed in the prior art. For example, a mechanical tea leaf and tea stem separating device is disclosed by the present disclosure with the application number of CN201820610336.3.). The tea stems are too heavy to exceed the height of the falling port 412, so that the tea stems remain and enter the inclined converging groove 413.

Further, the length of the inclined converging groove 413 is not less than that of the separating roller 41, so that the blocked materials are prevented from flying out of the separating roller 41; and the length of the gradual change column bag group 418 is not greater than that of the separating roller 41, so that the blocked materials are further prevented from flying out of the gradual change column bag group 418.

Further, the two end surfaces of the strip-shaped sieve plate 73 are provided with elastic baffles 74, and the elastic baffles 74 are used for preventing the materials from directly falling into the strip-shaped sieve plate 73, so that the tea stems and the granular tea leaves are prevented from passing through the opening of the strip-shaped sieve plate 73.

Through the arrangement, the strip-shaped sieve plate 73 becomes a closed vibrating screen, and finally, the tea leaves are at the uppermost position among various materials accumulated on the strip-shaped sieve plate 73.

The strip-shaped sieve plate 73 is slidably connected with a pushing baffle 75. The strip-shaped sieve plate 73 is provided with a limiting strip 76 for blocking the pushing baffle 75. The pushing baffle 75 is connected with a grid rack 77.

The pushing baffle 75 can slide along the side wall of the strip-shaped sieve plate 73 with the grid rack 77, and pushes the materials to press down the elastic baffle 74 in the sliding process and sends the materials into the collection box 61.

In this way, when the strip-shaped sieve plate 73 swings left and right, the pushing baffle 75 sliding along the side wall of the strip-shaped sieve plate 73 drives the grid rack 77 to move together. At that time, the grid rack 77 can sweep the tea leaves at the uppermost position of various materials into the collection box 61, and the tea stems and small particles can remain on the strip-shaped sieve plate 73.

The above embodiments are only exemplary embodiments of the application, and are not intended to limit the application. The scope of protection of the application is defined by the claims. Those skilled in the art can make various modifications or equivalent substitutions to the application within the scope of essence and protection, and these modifications or equivalent substitutions should also be regarded as falling within the scope of protection of the application.

What is claimed is:

1. A tea leaf and tea stem separating device, comprising a machine shell (1), wherein a collecting mechanism (2), a peeling mechanism (3), a separating mechanism (4), a rocker mechanism (7) and recycling mechanisms (6) are sequentially arranged on the machine shell (1) in the falling direction of materials, a driving mechanism (8) is arranged at the position, corresponding to the separating mechanism (4), of the inner wall of the machine shell (1), the driving mechanism (8) is provided with a conveyor belt mechanism (5) connected with the peeling mechanism (3), the separating mechanism (4) and the rocker mechanism (7), and the driving mechanism (8) can drive the conveyor belt mechanism (5) to move so as to pull the peeling mechanism (3), the separating mechanism (4) and the rocker mechanism (7) to synchronously reciprocate;

the peeling mechanism (3) comprises at least three soft-bristled brushes (31) which are arranged in parallel and both ends of which are connected with the inner wall of the machine shell (1), the transmission end of each soft-bristled brush (31) is connected with the conveyor belt mechanism (5), and the conveyor belt mechanism (5) can drive the at least three soft-bristled brushes (31) to rotate to screen the materials;

the separating mechanism (4) comprises separating rollers (41) arranged in parallel on the side, close to the rocker mechanism (7), of the soft-bristled brush (31), a connecting rod (42) connected with the inner wall of the machine shell (1) penetrates through the axis of the separating roller (41), the transmission end of the separating roller (41) is connected with the conveyor belt mechanism (5), the output end of the driving mechanism (8) is connected with the connecting rod (42) penetrating through the axis of the separating roller (41) and can drive the connecting rod (42) to rotate so as to guide the conveyor belt mechanism (5) to work, and the conveyor belt mechanism (5) can rotate the separating roller (41) while driving the at least three soft-bristled brushes (31) to rotate so as to further screen the materials; and the rocker mechanism (7) comprises a first rocker (71) and two second rockers (72) which are arranged in parallel with the separating roller (41), and a strip-shaped sieve plate (73) which is horizontally arranged at the bottom of the machine shell (1), the two second rockers (72) are respectively arranged on one side surface of the strip-shaped sieve plate (73) in parallel and connected with the inner wall of the machine shell (1), the first rocker (71) is arranged on the other side surface of the strip-shaped sieve plate (73), the end of the first rocker (71) is connected with the inner wall of the machine shell (1), the side wall of the first rocker (71) is connected with the conveyor belt mechanism (5), and the conveyor belt mechanism (5) can drive the first rocker (71) to reciprocate while driving the peeling mechanism (3) and the separating mechanism (4) to move.

2. The tea leaf and tea stem separating device according to claim 1, wherein the recycling mechanisms (6) comprise two collection boxes (61), the two collection boxes (61) are respectively connected to the two sides of the machine shell (1), and the collection boxes (61) are used for storing the materials screened out by the strip-shaped sieve plate (73).

3. The tea leaf and tea stem separating device according to claim 1, wherein the collecting mechanism (2) comprises a material inlet (21) and an internal collecting port (22), the material inlet (21) is connected to the top outer wall of the machine shell (1) and located just above the peeling mechanism (3), the internal collecting port (22) is connected to the top inner wall of the machine shell (1) and located just below the material inlet (21), the two ends of the internal collecting port (22) are provided with material baffles (23), and the material baffles (23) are located on the two sides of the peeling mechanism (3).

4. The tea leaf and tea stem separating device according to claim 1, wherein the conveyor belt mechanism (5) comprises a plurality of driven pulleys (53) for driving the peeling mechanism (3) to move, a driving pulley (54) for driving the separating mechanism (4), a second pulley (51) and a third pulley (52);

the driven pulleys (53) are respectively connected to the transmission ends of the at least three soft-bristled brushes (31) in one-to-one correspondence, and the driven pulleys (53) can be driven by the driving pulley (54) so as to guide the soft-bristled brushes (31) to rotate and screen the materials;

both the second pulley (51) and the driving pulley (54) sleeve the side wall of the connecting rod (42), both the second pulley (51) and the driving pulley (54) are arranged at the transmission end of the separating roller (41), and the driving pulley (54) can drive the driven pulleys (53) to rotate so that the separating roller (41) and the soft-bristled brushes (31) simultaneously rotate to further screen the materials; and the first rocker (71) is connected with the third pulley (52), the second pulley (51) is connected with the third pulley (52) through a belt, and the output end of the driving mechanism (8) is connected with the connecting rod (42) penetrating through the axis of the separating roller (41) and can drive the connecting rod (42) to rotate so as to guide the second pulley (51), the driving pulley (54) and the first rocker (71) to simultaneously rotate.

5. The tea leaf and tea stem separating device according to claim 1, wherein an outer cover cylinder (411) connected with the inner wall of the machine shell (1) sleeves the outer side of the separating roller (41), a falling port (412) is formed in the surface of the outer cover cylinder (411), an inclined converging groove (413) is formed in the interior of the outer cover cylinder (411), a plurality of filtering holes (414) are formed in the inner wall of the inclined converging groove (413), and a storage groove (415) is formed in the bottom inner wall of the inclined converging groove (413); and the outer side wall of the separating roller (41) is provided with a screw propelling channel (416), a roller pressing column (417) is connected into the screw propelling channel (416), a spacing channel is arranged on the screw propelling channel (416), and the position, corresponding to the falling port (412), of the inner wall of the outer cover cylinder (411) is provided with a gradual change column bag group (418).

6. The tea leaf and tea stem separating device according to claim 5, wherein a rotating half cylinder (92) matched with the longitudinal section shape of the storage groove (415) is rotatably connected into the storage groove (415), an interlayer (419) is arranged between the inner wall and the outer wall of the outer cover cylinder (411), a packing block (9) is connected into the interlayer (419), adjusting holes (91) are formed in the positions, corresponding to the filtering holes (414), of the surface of the packing block (9), both ends of the packing block (9) are connected with the rotating half cylinder (92), and the rotating half cylinder (92) can push the packing block (9) to reciprocate in the interlayer (419).

7. The tea leaf and tea stem separating device according to claim 6, wherein a winnowing sleeve (93) is arranged at the end, away from the driving mechanism (8), of the outer cover cylinder (411), an inclined guide surface (95) is arranged between the winnowing sleeve (93) and the edge of the inclined converging groove (413), an winnowing plate (94) is installed at the bottom of the winnowing sleeve (93), and the inclined guide surface (95) can guide tea stems to enter the inclined converging groove (413).

8. The tea leaf and tea stem separating device according to claim 5, wherein the length of the inclined converging groove (413) is not less than that of the separating roller (41), and the length of the gradual change column bag group (418) is not greater than that of the separating roller (41).

9. The tea leaf and tea stem separating device according to claim 1, wherein the two end surfaces of the strip-shaped sieve plate (73) are provided with elastic baffles (74), and the elastic baffles (74) are used for preventing the materials from directly falling into the strip-shaped sieve plate (73).

10. The tea leaf and tea stem separating device according to claim 9, wherein the strip-shaped sieve plate (73) is slidably connected with a pushing baffle (75), the strip-shaped sieve plate (73) is provided with a limiting strip (76) for blocking the pushing baffle (75), and the pushing baffle (75) is connected with a grid rack (77); and the pushing baffle (75) can slide along the side wall of the strip-shaped sieve plate (73) with the grid rack (77), and pushes the materials to press down the elastic baffle (74) in the sliding process and sends the materials into the collection box (61).

* * * * *